United States Patent [19]

Achelpohl

[11] 3,988,019

[45] Oct. 26, 1976

[54] APPARATUS FOR DEPOSITING FLAT ARTICLES FED BETWEEN BELTS

[75] Inventor: Fritz Achelpohl, Lengerich, Westphalia, Germany

[73] Assignee: Windmoller & Holscher, Lengerich, Westphalia, Germany

[22] Filed: Apr. 29, 1975

[21] Appl. No.: 572,739

[30] Foreign Application Priority Data

May 8, 1974 Germany ..... 2422290

[52] U.S. Cl. ..... 271/180; 271/184; 271/198; 271/274

[51] Int. Cl.[2] ..... B65H 29/46

[58] Field of Search ..... 271/180, 181, 177, 184, 271/225, 274, 273, 198, 199; 198/106

[56] References Cited

UNITED STATES PATENTS

| | | | |
|---|---|---|---|
| 457,187 | 8/1891 | Eckerson | 271/180 |
| 478,347 | 7/1892 | Meisel | 271/180 |
| 1,133,959 | 3/1915 | Henderson | 271/180 |
| 2,391,170 | 12/1945 | Labombarde | 271/198 X |

*Primary Examiner*—John J. Love
*Assistant Examiner*—Bruce H. Stoner, Jr.
*Attorney, Agent, or Firm*—Fleit & Jacobson

[57] ABSTRACT

In an apparatus for depositing flat articles that are being fed whilst clamped between a pair of double belt conveyors engaging said articles near respective margins thereof, a cam-operated thrust ejector is disposed between the double belt conveyors and is adapted to move through the conveying plane of the conveyors each time an article is to be ejected from the conveyors. The belts of the conveyors are compressible by rollers disposed to both sides thereof, the rollers on at least one side being retractable by control means when the ejector is actuated.

9 Claims, 3 Drawing Figures

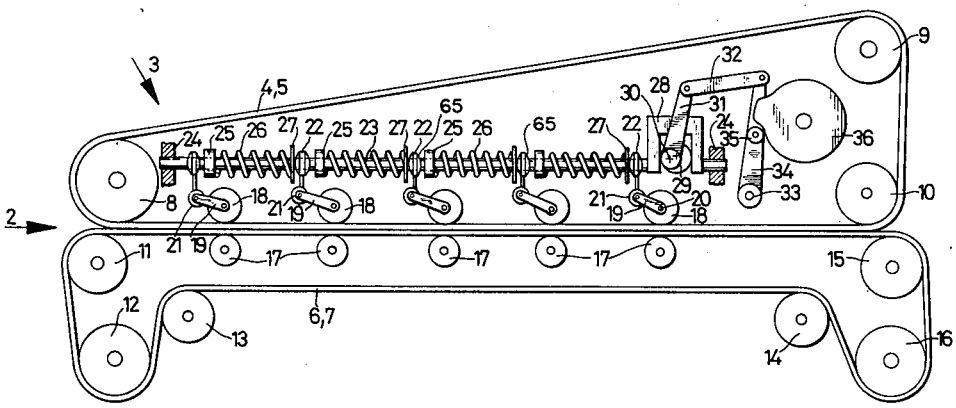

APPARATUS FOR DEPOSITING FLAT ARTICLES FED BETWEEN BELTS

Figure 1:
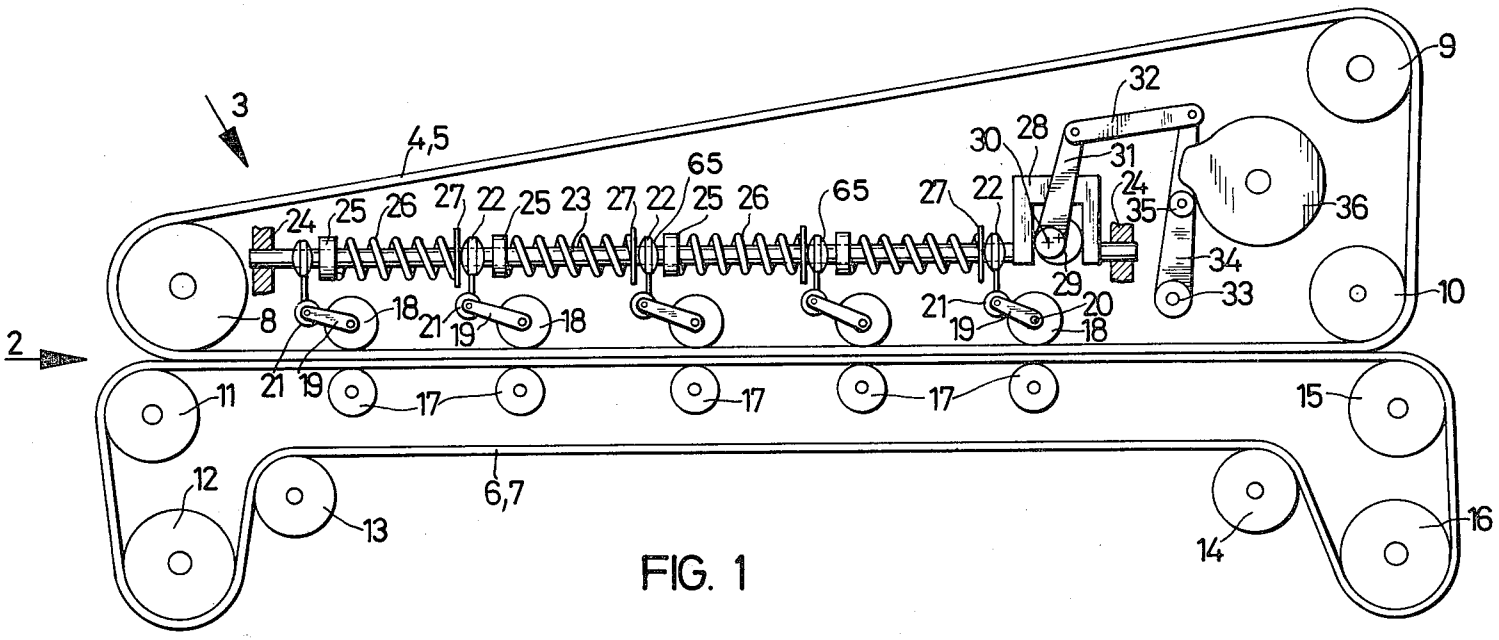

The invention relates to an apparatus for depositing flat articles that are being fed between a pair of double belt conveyors which engage the articles near respective margins thereof, comprising a cam-operated thrust ejector disposed between the double belt conveyors and adapted to move through the conveying plane of the conveyors.

In an apparatus of this kind known from German Specification 1,067,675, the ejector pulls the flat article from the conveyor belts that clamp same, so that it then falls on a support therebelow. Flat articles, particularly those of plastics material, are difficlt to push from between the conveyor belts because of the clamping action exerted thereby. Very oten the articles are ejected unevenly or from only the belts at one margin thereof. This leads to faulty operation and incorrect depositing of the articles. On the other hand, the uniform depositing of the articles is a prerequisite for forming edge-aligned stacks or a uniform overlapping arrangement of scale formation in the case where the articles are deposited on a continuously moving conveyor belt.

It is an object of the invention to provide a depositing apparatus which permits the efficient depositing of articles at regular time intervals.

In an apparatus of the aforementioned kind, the invention provides that the belts of the conveyors are compressible by rollers disposed to both sides thereof, the rollers on at least one side being retractable by control means on actuation of the ejector.

By reason of the retractable rollers, the articles are only lightly held by the conveyors by the time that the thrust ejector comes into operation and consequently precise depositing of the articles is possible because the conveyors will no longer exert restraining forces that might cause the articles to become displaced.

Each retractable roller may be mounted at the end of one arm of a bell crank lever of which the other arm is operable by the control means. To increase the holding pressure, the retractable rollers may be spring-influenced. Desirably, the control means include a rod common to all the retractable rollers and carrying an abutment associated with each retractable roller, each said abutment being embraced in the manner of a fork by said other arm of the bell crank lever.

The depositing of the flat articles in a proper time sequence is facilitated if the ejector is actuated suddenly at predetermined times. In one form of the invention, therefore, the cam which operates the ejector first stresses a spring acting on the ejector and then releases a latch for freeing the ejector. After the time-controlled release of the latch, the ejector, accelerated by the spring force, impells the article out of the conveyor belts at its margins and hence deposits it at uniform time intervals.

The ejector may be mounted on levers pivoted to the frame of the apparatus, at least one of said levers being a bell crank lever the free arm of which is engaged by said spring that acts on the ejector. The free lever arm preferably comprises an abutment resting against the aforementioned latch, the latch being retractable by linkage controlled by said cam. The latch is held by a further spring in a blocking position at which the abutment rests against it, the retracting linkage comprising a rod which passes through a guide sleeve pivoted to said free lever arm and on which the spring acting on the ejector is mounted between a further abutment and the guide sleeve. The rod may be pivoted to a lever that can be swung by said cam and that can be pressed thereagainst under spring force so as to return the ejector to its starting position after each actuation.

By means of the invention, flat articles, whether these be flimsy or even heavy bags or sacks, can be reliably fed towards the ejector and then deposited by the latter at correct time intervals and at an exact position, whereby successive articles are deposited uniformly, either as a stack on a fixed support or as a uniform stream of overlapping articles on a constantly moving conveyor belt.

Figure 2:
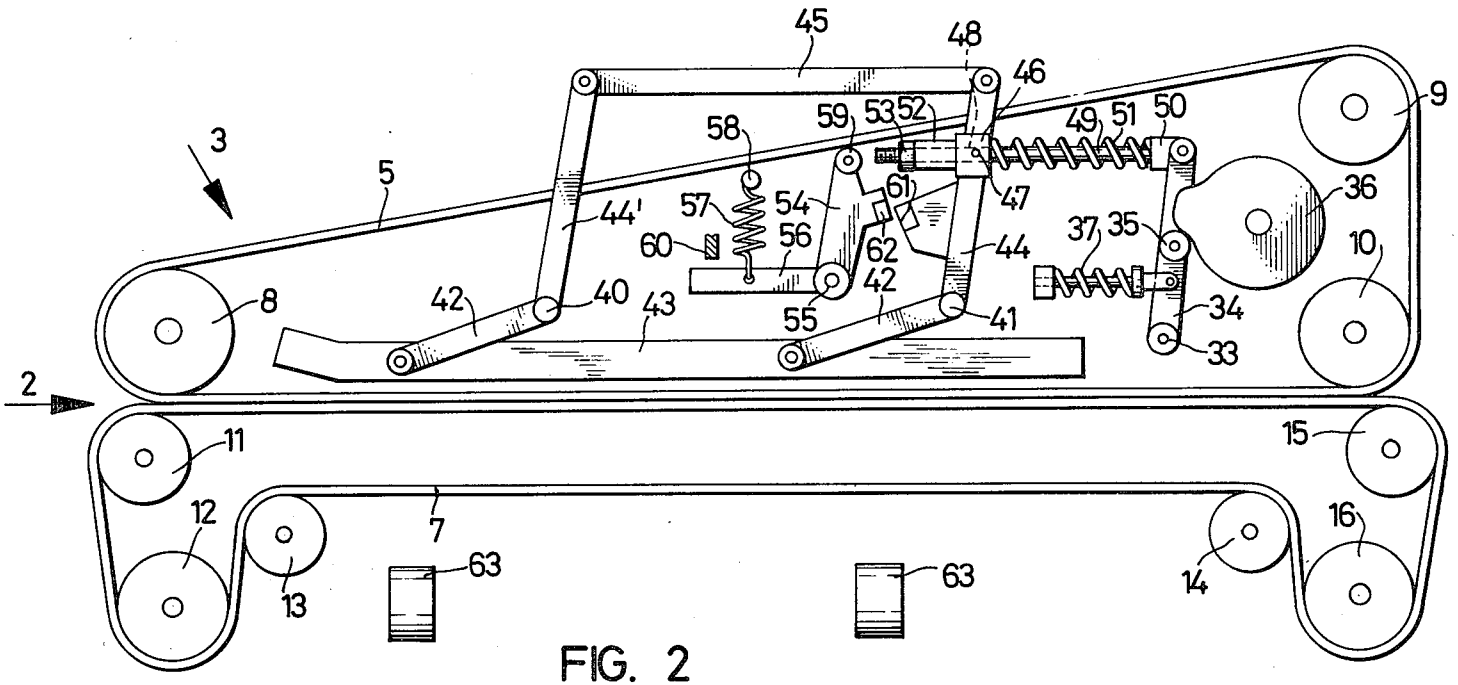
Figure 3:
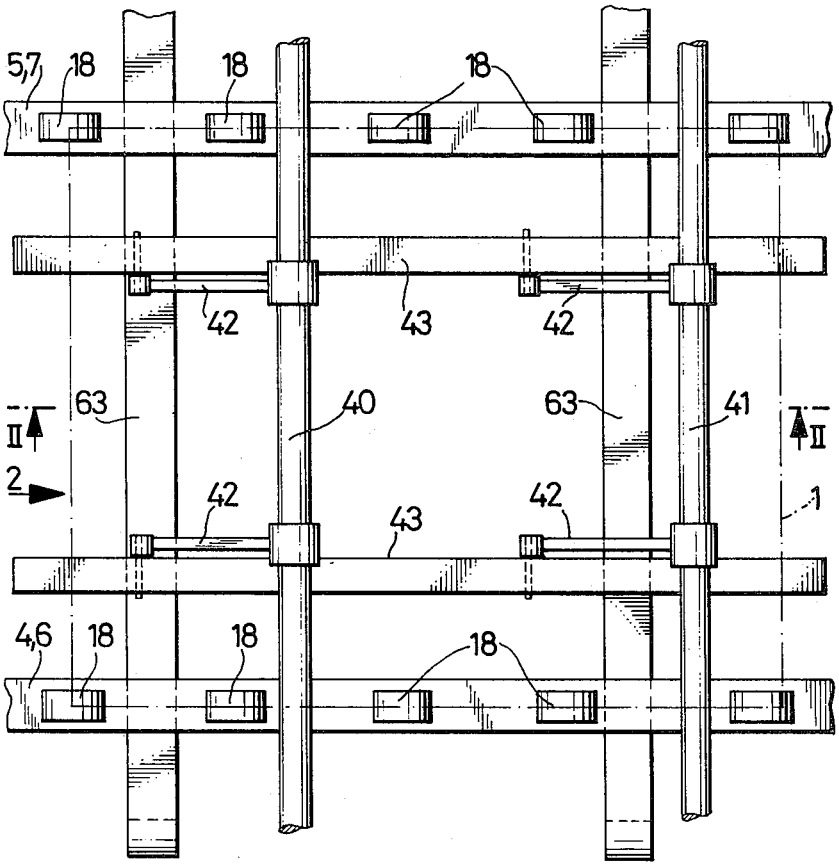

An example of the invention will now be described with reference to the accompanying diagrammatic drawings, wherein:

FIG. 1 is a side elevation of a depositing apparatus;
FIG. 2 is a section on the line II—II in FIG. 3, and
FIG. 3 is a plan view of the FIG. 1 apparatus.

With the aid of suitable supply conveyor means (not shown), flat articles 1 are fed at equal time intervals in the direction of the arrow 2 to a continuously moving belt arrangement 3 which comprises conveyor belts 4, 5, 6 and 7. The upper belts 4, 5 pass over rollers 8, 9, 10 and the lower belts 6, 7 pass over rollers 11 to 16. The rollers 8, 11 and 10, 15 serve to bring the belts 4, 6 and 5, 7, respectively, together in pairs so that their runs define a gap in which the margins of the articles 1 are engaged for transport in the direction of the arrow 2. In order to support the belts 4 to 7, which tend to sag under their own weight and the weight of the articles, a series of supporting rollers 17 is provided in the vicinity of the gap beneath the belts 6, 7, these rollers 17 being loosely rotatable on shafts carried by the frame of the apparatus. Pressure rollers 18 are provided above the supporting rollers 17 and the pairs of belts 4, 6 and 5, 7. The pressure rollers 18 ensure that each article 1 is clamped in the gap between the pairs of belts, thereby preventing it from slipping out under its own weight. The pressure rollers 18 are freely rotatably mounted on levers 19 fixed to shafts 20. The levers 19 are pivotable about shafts 21 fixed to the frame of the apparatus and are integral with arms 22 which are bifurcated to embrace the rod 23 at an abutment 65, in the manner of a fork. The levers 19 and arms 22 thus define a bell crank lever. The rod 23 is displaceable in fixed bearings 24 in a longitudinal direction and carries fixed rings 25 supporting one end of respective compression springs 26. The other end of each compression spring is supported by abutments 65 carried by the rod 23, each abutment being embraced by each bifurcated lever 22, a washer 27 being provided between each abutment 65 and compression spring 26. Engaging an end of the rod 23 there is an eccentric shaft 29 which is trapped in a frame 28 carried by the rod 23 and rotatable about its eccentric axis 30 constituted by a shaft carried by the frame of the apparatus. The eccentric shaft 29 carries a lever 31 connected by a link 32 to a lever 34 which is pivotable about a shaft 33 fixed to the frame of the apparatus. The lever 34 carries a rotatable roller 35 which constitutes a cam follower co-operating with a cam 36. The cam 36 is driven to rotate in sequence with the machine cycle. The aforementioned rings 25 are adjusted relatively to the bifurcated levers 22 so that, when the lever 31 is pivoted to the left with corresponding movement of the rod 23, each lever 22 is swung about the shaft 21 whereby the pressure rollers 18 are raised from the belts 4, 5 against spring force.

The construction, arrangement and operation of the pressure rollers 18 are identical for each pair of belts.

For the sake of clarity, the rollers 17, 18 acting on the belts 5, 7 and their control mechanisms have been omitted from FIG. 2. Pivotally mounted in side walls of the frame of the apparatus there are shafts 40, 41 to which levers 42 are fixed at the ends of which the thrust ejector 43 is hinged. The lower edge of the ejector is disposed closely above the gap formed between the belts 4, 6 and 5, 7 in which the margin of the articles 1 are held. By pivoting the levers 42 about the shafts 40, 41, the ejector can be swung below the horizontal plane of the gap.

Fixed to the shafts 40, 41 there are levers 44, 44' of which the ends are interconnected by a link 45. The levers 44, 44' thereby form bell crank levers together with the levers 42. A sleeve 46 pivoted about a shaft 47 fixed to the lever 44 has a central bore 38 through which a rod 49 is passed which is hinged to the aforementioned lever 34 that was described in relation to FIG. 1. By means of the roller 35, the lever 34 lies against the cam 36 under the force of the compression spring 37. A compression spring 51 is disposed between the sleeve 46 and an abutment 50 on the rod 49. On the side of the sleeve opposite to the compression spring 51, an abutment 52 is screwed onto the rod 49 and secured by a lock nut 53. The sleeve 46 is pressed against the abutment 52 under the action of the compression spring 51.

A lever 54 substantially parallel to the lever 44 is pivotable about a shaft 55 fixed to the frame of the apparatus. The lever 54 forms one arm of a bell crank lever of which the other arm 56 supports one end of a tension spring 57. The other end of the tension spring is secured by a bolt 58 fixed to the frame of the apparatus. A roller 49 is loosely rotatable on the lever 54. The roller 59 is disposed in the path of movement of the rod 49. Swinging of the lever 54 is limited by an adjustable stop 60 against which the lever arm 56 is pulled by the spring 57.

An abutment 61 is provided on the lever 44 which actuates the ejector 53 and a latch 62 is provided on the lever 54. The sleeve 46 lies against the abutment 52 of the rod 49 under the force of the compression spring 51. This abutment 52 is adjusted relatively to the rod 49 so that the abutment 61 does not contact the latch 62 until the cam follower roller 35 runs onto the eccentric portion of the cam 36. If the rod 49 is moved to the left by the cam 36, its end strikes the roller 59 and pivots the lever 54 against the force of the tension spring 57. The latch 62 thereby releases the abutment 61 and the ejector 43 is thrust downwardly under the force of the compression spring 51 stressed by the cam 36. Disposed transversely beneath the belts 6, 7 there are conveyor belts 63 for taking the ejected articles 1 away in an overlapping arrangement. As soon as the roller 35 has left the eccentric portion of the cam 36, the spring 37 pushes the lever 34 towards the right-hand side and thereby returns the ejector to its starting position above the conveying plane of the belts 4, 5, 6, 7.

A brief description of the operation of the apparatus will now be given. The cam 36 which rotates in sequence with the machine cycle in accordance with the speed of the belts 4, 5, 6, 7 assumes a rotary position as shown in FIGS. 1 and 2 when an article has reached the position shown in FIG. 3. On further rotation of the cam 36, the eccentric shaft 29 is turned by the lever 31 so that the rollers 18 are lifted from the belts 4, 5. This reduces the force with which the article 1 is clamped in the gap between the belts 4, 6 and 5, 7. At the same time the lever 34 is pivoted to the left, whereby the rod 49 is moved towards the roller 59 of the lever 54. Since the rod 49 passes through the compression spring 51, the latter is stressed between the sleeve 46 and abutment 50. The end of the rod 49 swings the lever 54 to the left so that the abutment 61 is released by the latch 62. Under the action of the spring 51, the lever 54 is then moved to the left until the guide sleeve 46 again strikes the abutment 52. This causes the ejector 43 to be moved suddenly through the conveying plane of the belts 4, 5, 6, 7 to eject the article that is at this stage only lightly held by the belts. The article is consequently accurately deposited on the conveyor belts 63 at a predetermined time. On further rotation of the cam 36, the lever 34 returns to its FIG. 2 position under the action of the compression spring 37. This also returns the rod 49 to its starting position, the levers 44 and 42 being carried along by the abutment 52 so that the ejector 43 is also returned to its starting position above the belts 4, 5. When the abutment 61 has returned to the position shown in FIG. 2, the lever 54 is swung against the abutment 60 by the tension spring 57 so that the latch 62 again blocks the abutment 61. The aforementioned operating cycle can then be repeated for ejecting the next flat article.

I claim:

1. Apparatus for depositing flat articles that are fed between a pair of double belt conveyors comprising, a pair of laterally spaced upper conveyor belts and a pair of laterally spaced lower conveyor belts, the upper run of each lower belt confronting the lower run of each respective upper belt, said articles engaged between said upper and lower belts near respective margins thereof, a cam-operated thrust ejector disposed between the laterally spaced conveyor belts and adapted to move through the conveying plane of the belts, rollers disposed on one side of one of said pairs of conveyor belts, retractable rollers disposed on one side of the other pair of conveyor belts, wherein said rollers and said retractable rollers compress the conveyor belts, and control means for retracting said retractable rollers away from said other pair of conveyor belts and for actuating the thrust ejector.

2. Apparatus according to claim 1, wherein each retractable roller is mounted at the end of one arm of a bell crank lever of which the other arm is operable by said control means.

3. Apparatus according to claim 2, wherein said control means include a rod common to all the retractable rollers, an abutment associated with each retractable roller and carried by said rod, said other arm of said bell crank lever comprising a bifurcated fork, wherein said bifurcated fork embraces said abutment.

4. Apparatus according to claim 1, wherein said control means further comprises a cam, a compression spring stressed by said cam, and a latch means positioned adjacent to said thrust ejector and movable by said cam to a position whereby said thrust ejector is free to move through the conveying plane of the belts by the force of the compression spring.

5. Apparatus according to claim 4, wherein said thrust ejector is mounted on levers, at least one of said levers being a bell crank lever, the free arm of which is engaged by said compression spring for accelerating the thrust ejector.

6. Apparatus according to claim 5, wherein said free lever arm comprises an abutment positioned adjacent to said latch means, and retracting linkage means controlled by said cam for releasing said latch means.

7. Apparatus according to claim 6, wherein said latch means is held by a tension spring in a blocking position adjacent to the abutment of said free lever arm, and said retracting linkage means further comprises a rod, a further abutment mounted on said rod, a guide sleeve pivoted to said free lever arm and adapted to receive and guide said rod, and wherein said compression spring is mounted between said further abutment and said guide sleeve.

8. Apparatus according to claim 7, wherein said rod is pivotally connected to a lever pivoted by said cam, and a second compression spring attached to said lever to maintain said lever against said cam.

9. Apparatus according to claim 1 further comprising spring means for influencing said retractable rollers into compressing said conveyor belt.

* * * * *